US011913087B2

(12) United States Patent
Shiimori et al.

(10) Patent No.: US 11,913,087 B2
(45) Date of Patent: Feb. 27, 2024

(54) HIGH-STRENGTH STEEL SHEET AND METHOD FOR PRODUCING SAME

(71) Applicant: JFE STEEL CORPORATION, Tokyo (JP)

(72) Inventors: Fusae Shiimori, Tokyo (JP); Hayato Saito, Tokyo (JP); Nobusuke Kariya, Tokyo (JP); Katsumi Kojima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 491 days.

(21) Appl. No.: 16/754,138

(22) PCT Filed: Oct. 29, 2018

(86) PCT No.: PCT/JP2018/040182

§ 371 (c)(1),
(2) Date: Apr. 7, 2020

(87) PCT Pub. No.: WO2019/088044

PCT Pub. Date: May 9, 2019

(65) Prior Publication Data

US 2020/0332383 A1 Oct. 22, 2020

(30) Foreign Application Priority Data

Oct. 31, 2017 (JP) ..... 2017-211181

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/26* (2013.01); *C22C 38/28* (2013.01); *C22C 38/32* (2013.01); *C21D 2211/005* (2013.01); *C21D 2211/008* (2013.01)

(58) Field of Classification Search

CPC ... C21D 8/0226; C21D 8/0236; C21D 8/0263
See application file for complete search history.

(56) References Cited

U.S. PATENT DOCUMENTS

| | | | | |
|---|---|---|---|---|
| 8,795,443 | B2 | 8/2014 | Nishihara et al. | |
| 8,911,567 | B2 | 12/2014 | Ogawa et al. | |
| 10,837,076 | B2 | 11/2020 | Saito et al. | |
| 2012/0180909 | A1* | 7/2012 | Ono | C22C 38/58 148/333 |
| 2012/0282487 | A1* | 11/2012 | Ogawa | C23C 2/024 148/333 |
| 2017/0314095 | A1* | 11/2017 | Saito | B21B 1/22 |
| 2019/0085421 | A1 | 3/2019 | Takashima et al. | |

FOREIGN PATENT DOCUMENTS

| | | | |
|---|---|---|---|
| CN | 102409222 | A | 4/2012 |
| CN | 101802236 | B | 5/2012 |
| CN | 102597292 | A | 7/2012 |
| CN | 103320685 | A | 9/2013 |
| CN | 106399836 | A | 2/2017 |
| CN | 107109556 | A | 8/2017 |

(Continued)

OTHER PUBLICATIONS

Aug. 18, 2021, Office Action issued by the China National Intellectual Property Administration in the corresponding Chinese Patent Application No. 201880055839.1 with English language search report.

Jan. 22, 2019, International Search Report issued in the International Patent Application No. PCT/JP2018/040182.

Aug. 11, 2021, Office Action issued by the Korean Intellectual Property Office in the corresponding Korean Patent Application No. 10-2020-7003785 with English language concise statement of relevance.

Jan. 13, 2021, Office Action issued by the China National Intellectual Property Administration in the corresponding Chinese Patent Application No. 201880055839.1 with English language search report.

ASTM International, ASTM A623-11 Standard Specification for Tin Mill Products, General Requirements, 2011, West Conshohocken, PA; ASTM International.

*Primary Examiner* — Anthony M Liang
*Assistant Examiner* — Jacob J Gusewelle
(74) *Attorney, Agent, or Firm* — KENJA IP LAW PC

(57) ABSTRACT

Provided is a high-strength steel sheet having excellent ductility, bendability, and TS of 500 MPa or more, in particular, a high-strength thin steel sheet for cans having a sheet thickness of 0.1 to 0.8 mm, the steel sheet having a chemical composition containing C: 0.03-0.15%, Si: 0.01-0.05%, Mn: more than 0.6% and 1.5% or less, P: 0.025% or less, S: 0.02% or less, Al: 0.01-0.10%, N: 0.0005-0.0100%, Ti: 0.005-0.020%, B: 0.0005-0.0100%, and Nb: 0.0050-0.0200% with the balance being Fe and inevitable impurities, in which the steel sheet has a metallic structure containing, in area ratio, 85% or more of ferrite and 1-10% of martensite, the martensite has a grain size of 5 μm or less, and a ratio of martensite having a grain size of 2 μm or less is 80% or more.

5 Claims, No Drawings

(56) References Cited

FOREIGN PATENT DOCUMENTS

| | | | | | |
|---|---|---|---|---|---|
| JP | S-55122821 | A | * | 9/1980 | |
| JP | 2000017387 | A | | 1/2000 | |
| JP | 2008274332 | A | | 11/2008 | |
| JP | 4235247 | B1 | | 3/2009 | |
| JP | 2009084687 | A | | 4/2009 | |
| JP | 2010013700 | A | | 1/2010 | |
| JP | 2013224476 | A | | 10/2013 | |
| JP | 6048618 | B2 | | 12/2016 | |
| JP | 2017025352 | A | | 2/2017 | |
| JP | 6240405 | B2 | * | 11/2017 | |
| KR | 1020100029132 | A | | 3/2010 | |
| KR | 101411228 | B1 | | 6/2014 | |
| WO | WO-2009035120 | A1 | * | 3/2009 | ..... C22C 38/001 |
| WO | 2016157878 | A1 | | 10/2016 | |
| WO | 2017169941 | A1 | | 10/2017 | |

* cited by examiner

HIGH-STRENGTH STEEL SHEET AND METHOD FOR PRODUCING SAME

TECHNICAL FIELD

This disclosure relates to a high-strength steel sheet excellent in ductility and bendability which is suitable for, in particular, materials for containers, for example, a high-strength steel sheet having a tensile strength (TS) of 500 MPa or more and a method for producing the same.

BACKGROUND

To reduce costs, sheet metal thinning of steel sheets for cans has been recently promoted through strengthening. Specifically, high-strength thin steel sheets having TS of 500 MPa or more are being considered for use in cans.

When a steel sheet is strengthened, workability is typically lowered. For example, steel sheets used for pull tabs need to have both sufficient strength for preventing a pull tab from being bent in opening a can and sufficient workability, in particular, bendability, when processed into pull tabs. Further, a ring portion of a pull tab is touched by fingers in opening a lid, and thus needs to have a bent portion without wrinkles. On the other hand, steel sheets used in canopy portions of aerosol cans need to have both sufficient steel sheet strength for ensuring pressure resistance and sufficient workability, in particular, ductility, for forming a counter sink and the like. Therefore, there is demand for development of a high-strength thin steel sheet having high strength and excellent ductility and bendability.

To meet such demand, for example, JP 4235247 B (PTL 1) describes a high-strength thin steel sheet for can manufacturing having a complex microstructure of ferrite and martensite as a steel microstructure mainly composed of ferrite in which the volume fraction of martensite is 5% or more and less than 30%, the steel sheet being defined as to the martensite grain size, the product sheet thickness, martensite hardness, and 30 T hardness.

JP 6048618 B (PTL 2) describes a steel sheet having a ferrite phase as a primary phase and a martensite phase and/or a retained austenite phase as a secondary phase in a total area fraction of 1.0% or more.

CITATION LIST

Patent Literatures

PTL 1: JP 4235247 B
PTL 2: JP 6048618 B

SUMMARY

Technical Problem

However, it is difficult to obtain a tensile strength of 500 MPa or more in the steel sheet described in PTL 1.

The technique described in PTL 2 suffers from high cost because it requires secondary rolling. Further, the technique may not provide enough bendability.

It could thus be helpful to provide a high-strength steel sheet having excellent ductility and bendability, and TS of 500 MPa or more, in particular, a high-strength thin steel sheet having a sheet thickness of 0.1 mm to 0.8 mm which generates no wrinkle at a bent portion of a pull tab ring of a can when the steel sheet is used for cans, and the method for producing the same.

As used herein, the term "high-strength steel sheet" refers to a steel sheet having a tensile strength (TS) of 500 MPa or more. Similarly, the term "excellent ductility" means elongation (EL) of 15% or more, the term "excellent bendability" means that a test piece has no crack on the outside of a curved portion thereof when subjected to a 180° bend test, and the phrase "no wrinkle at the bent portion thereof" means that when the steel sheet is processed into a pull tab ring, the pull tab ring has no wrinkle at the bent portion thereof.

Solution to Problem

The inventors made intensive studies to solve the problem stated above and as a result, discovered that a high-strength steel sheet having remarkably excellent ductility and bendability compared with conventional ones and TS of 500 MPa or more is obtained by adjusting the steel components, the area ratios of ferrite and martensite in the metallic structure, and the martensite size. In particular, the inventors discovered that a high-strength steel sheet which has no wrinkle at the bent portion thereof when subjected to bending and is suitable for, for example, pull tabs is obtained by controlling the ratio of martensite in a predetermined size range to be within a predetermined range. Further, the inventors discovered that as the producing conditions, strictly controlling the rolling reduction at a final stand in a hot rolling step, the heating rate, annealing temperature, and cooling rate after annealing in an annealing step, and the holding time at a cooling stop temperature is suitable for adjusting the area ratios of ferrite and martensite in the metallic structure, and the martensite size.

The disclosure is based on the aforementioned discoveries. Specifically, we provide the following.

[1] A high-strength steel sheet comprising a chemical composition containing (consisting of), in mass %, C: 0.03% or more and 0.15% or less,
Si: 0.01% or more and 0.05% or less,
Mn: more than 0.6% and 1.5% or less,
P: 0.025% or less,
S: 0.02% or less,
Al: 0.01% or more and 0.10% or less,
N: 0.0005% or more and 0.0100% or less,
Ti: 0.005% or more and 0.020% or less,
B: 0.0005% or more and 0.0100% or less, and
Nb: 0.005% or more and 0.020% or less with the balance being Fe and inevitable impurities, wherein the high-strength steel sheet has a metallic structure comprising, in area ratio, 85% or more of ferrite and 1% or more and 10% or less of martensite, and the martensite has a grain size of 5 μm or less, and a ratio of martensite having a grain size of 2 μm or less is 80% or more.

[2] The high-strength steel sheet according to [1], having a tensile strength of 500 MPa or more.

[3] The high-strength steel sheet according to [1] or [2], wherein the metallic structure comprises, in area ratio, less than 8% of the martensite.

[4] The high-strength steel sheet according to any of [1] to [3], wherein the chemical composition further contains, in mass %, at least one selected from the group consisting of Cr: 0.005% or more and 0.100% or less,
Ni: 0.005% or more and 0.150% or less, and
Mo: 0.005% or more and 0.050% or less.

[5] A method for producing a high-strength steel sheet, the method comprising: hot rolling a slab having the chemical composition according to [1] or [4] with a hot-rolling finish temperature of 800° C. or higher and 950° C. or lower, a rolling reduction at a final stand of 8% or more, and a coiling temperature of 700° C. or lower to obtain a hot-rolled sheet; cold rolling the hot-rolled sheet with a rolling reduction of 80% or more to obtain a cold-rolled sheet; and subjecting the cold-rolled sheet to annealing whereby the cold-rolled sheet is heated at an average heating rate of 2° C./s or more and 35° C./s or less within a temperature range of 200° C. to a soaking temperature of 700° C. or higher and 850° C. or lower, held at the soaking temperature, and then cooled to a temperature range of 200° C. to 450° C. at an average cooling rate of 70° C./s or more to obtain an annealed sheet.

[6] The method for producing a high-strength steel sheet according to [5], the method further comprising: holding the annealed sheet for 300 seconds or less at a temperature not lower than 150° C. and not higher than a cooling stop temperature of the cooling.

Advantageous Effect

According to this disclosure, it is possible to provide a high-strength steel sheet having TS of 500 MPa or more and excellent ductility and bendability. The high-strength steel sheet of this disclosure has excellent ductility and bendability, and thus, it is suitable as a steel sheet for cans to be formed into a complicated shape, such as a steel sheet for pull tabs. Further, by applying parts produced according to this disclosure to cans, high strengthening and weight reduction are further promoted and would largely contribute to the development of industry.

DETAILED DESCRIPTION

The following explains the chemical composition and appropriate range of the microstructure of the high-strength steel sheet according to this disclosure and the reasons for the limitations thereof. In the description of the chemical composition, "%" represents "mass %" unless otherwise noted. Further, when the steel sheet has excellent ductility and bendability, the steel sheet may be merely referred to as having excellent workability.

C: 0.03% or More and 0.15% or Less

C is an element which contributes to strength and has an effect of increasing the strength of steel through solid dissolution in steel or precipitation as carbides. To make TS 500 MPa or more by using these effects, the C content needs to be 0.03% or more. On the other hand, the upper limit is 0.15% because an excessive C content may lower ductility and bendability due to an increase in strength and deteriorate weldability. Therefore, the C content is set to 0.03% or more and 0.15% or less, and preferably 0.05% or more and 0.12% or less.

Si: 0.01% or More and 0.05% or Less

Si contributes to high strengthening of steel by solid solution strengthening. To obtain these effects, the Si content needs to be 0.01% or more. On the other hand, a Si content more than 0.05% may severely degrade the corrosion resistance and surface characteristics. Therefore, the Si content is set to 0.01% or more and 0.05% or less, and preferably 0.02% or more and 0.03% or less.

Mn: More than 0.6% and 1.5% or Less

Mn forms a desired amount of martensite to thereby contribute to high strengthening. To obtain the strength intended by this disclosure, the Mn content needs to be more than 0.6%. That is, when the Mn content is 0.6% or less, a desired amount of martensite cannot be formed and thus, an intended strength cannot be obtained. Further, yield point extension which causes stretcher strain occurs and appearance after processing may be degraded. On the other hand, a Mn content more than 1.5% causes excessive production of martensite due to increased quench hardenability. The excessive production of martensite leads to deterioration of workability, in particular, bendability. Therefore, the Mn content is set to more than 0.6% and 1.5% or less, and preferably 0.8% or more and 1.4% or less.

P: 0.025% or Less

P is an element which is inevitably included in steel and useful for strengthening of steel. To obtain this effect, the P content is preferably 0.001% or more. On the other hand, P deteriorates weldability, and thus, the P content is set to 0.025% or less, and preferably 0.020% or less.

S: 0.02% or Less

S is inevitably included in steel, forms inclusions such as coarse MnS and significantly lowers local ductility. Thus, the S content is set to 0.02% or less, and preferably 0.015% or less. Reducing the S content below 0.0001% requires excessive cost for steel refinement. Therefore, the lower limit of S content is preferably 0.0001%, and more preferably 0.0005% or more.

Al: 0.01% or More and 0.10% or Less

Al acts as a deoxidizer. To obtain this effect, the Al content needs to be 0.01% or more, and preferably 0.03% or more. On the other hand, adding a large amount of Al results in increased production cost. Therefore, the Al content is set to 0.01% or more and 0.10% or less, and preferably 0.08% or less.

N: 0.0005% or More and 0.0100% or Less

N bonds with carbonitride forming elements such as Al to thereby form precipitates, contributing to increase in strength and refinement of a microstructure. To obtain this effect, the Al content needs to be 0.0005% or more. On the other hand, a high N content more than 0.0100% deteriorates anti-aging property. Therefore, the N content is set to 0.0005% or more and 0.0100% or less, and preferably 0.0010% or more and 0.0060% or less.

Ti: 0.005% or More and 0.020% or Less

Ti, which bonds with N to form TiN and suppress the formation of BN, can sufficiently produce an effect of improving quench hardenability of B. To obtain this effect, the Ti content needs to be 0.005% or more. On the other hand, adding Ti in an amount of 0.020% or more lowers workability due to an increase in strength. Therefore, the Ti content is set to 0.005% or more and 0.020% or less, and preferably 0.005% or more and 0.015% or less.

B: 0.0005% or More and 0.0100% or Less

B increases quench hardenability and suppresses the formation of ferrite occurring during cooling at an annealing process, thus contributing to obtaining desired martensite. To obtain this effect, the B content needs to be 0.0005% or more. On the other hand, a high B content more than 0.0100% saturates the effect. Therefore, the B content is set to 0.0005% or more and 0.0100% or less, and preferably 0.001% or more and 0.0080% or less.

Nb: 0.005% or More and 0.020% or Less

Nb, which has an effect of making crystal grains finer to thereby finely distribute martensite, is one of important additional elements in this disclosure. To obtain this effect, the Nb content needs to be 0.005% or more. On the other hand, a high Nb content more than 0.020% lowers ductility due to an increase in strength. Therefore, the Nb content is set to 0.005% or more and 0.020% or less, and preferably 0.008% or more and 0.018% or less.

The above component elements are essential and the balance other than the above is Fe and inevitable impurities.

Note that components other than the above may be contained without impairing the effects of this disclosure. That is, the steel sheet of this disclosure can obtain intended properties using the essential elements stated above, but, in addition to the essential elements, the following elements may be further contained as necessary: at least one selected from the group consisting of Cr: 0.005% or More and 0.100% or Less, Ni: 0.005% or More and 0.150% or Less, and Mo: 0.005% or More and 0.050% or Less Cr, Ni, and Mo have an effect of improving quench hardenability, and thus, they are useful as a steel-strengthening element. To effectively exhibit such an effect, Cr, Ni, and Mo are each preferably contained in an amount of 0.005% or more. On the other hand, Cr, Ni, and Mo are expensive elements, and adding them beyond the upper limits does not increase the effect. Therefore, it is preferable that the Cr content is 0.100% or less, the Ni content is 0.150% or less, and the Mo content is 0.050% or less. Accordingly, Cr: 0.005% or more and 0.100% or less, Ni: 0.005% or more and 0.150% or less, and Mo: 0.005% or more and 0.050% or less are preferable.

Next, the metallic structure which is an important requirement of the high-strength steel sheet of this disclosure is described. As used herein, the "area ratio" represents an area ratio with respect to the entire microstructure of a steel sheet.

Ferrite Area Ratio: 85% or More

Ferrite is formed during cooling after annealing and contributes to improvement of ductility of steel. When the ferrite area ratio is less than 85%, it is difficult to ensure desired ductility. Therefore, the ferrite area ratio is set to 85% or more, and preferably 90% or more.

Martensite Area Ratio: 1% or More and 10% or Less

In this disclosure, to ensure strength, martensite is partly introduced in the microstructure. However, when the martensite area ratio is more than 10%, strength increases to thereby lower ductility, and thus, workability cannot be ensured. On the other hand, when the martensite area ratio is less than 1%, desired strength cannot be obtained. Therefore, the martensite area ratio is set to 1% or more and 10% or less. To ensure a favorable balance between strength and elongation, the martensite area ratio is preferably less than 8%. The martensite area ratio can be measured using the method described in the following examples.

In the metallic structure, the balance including ferrite and martensite is not particularly limited. For example, the balance may also include retained austenite, cementite, pearlite, bainite, and the like.

Martensite Grain Size: 5 μm or Less

While martensite is a microstructure affecting the strength of a steel sheet, voids are generated originating from interfaces between martensite and ferrite during bending deformation, and act as starting points of cracks. Therefore, it is important to properly control the martensite grain size. When the martensite grain size is more than 5 μm, desired bendability cannot be obtained. As used herein, the phrase "the martensite has a grain size of 5 μm or less" means that martensite having a grain size of more than 5 μm is not observed in an observed location randomly selected in a steel sheet.

Martensite having a Grain Size of 2 μm or Less: 80% or More of the Entire Martensite Further, by finely dispersing martensite, stress concentration can be relaxed at an interface between martensite and ferrite, thus suppressing generation of cracks and imparting excellent bendability, and wrinkles can be suppressed at a bent portion such as a pull tab ring formed by severe bending. When the ratio of martensite having a grain size of 2 μm or less in the entire martensite is less than 80%, wrinkles are generated at a bent portion of the pull tab ring. To obtain this effect, the ratio of martensite having a grain size of 2 μm or less in the entire martensite needs to be 80% or more.

Therefore, the martensite grain size is set to 5 μm or less and the ratio of martensite having a grain size of 2 μm or less in the entire martensite is set to 80% or more.

The method for producing a high-strength steel sheet according to this disclosure comprises: hot rolling a slab having the chemical composition stated above with a hot-rolling finish temperature of 800° C. or higher and 950° C. or lower, a rolling reduction at a final stand of 8% or more, and a coiling temperature of 700° C. or lower to obtain a steel sheet; and then cold rolling the steel sheet with a rolling reduction of 80% or more, heating the steel sheet at an average heating rate of 2° C./s or more and 35° C./s or less within a temperature range of 200° C. to a soaking temperature of 700° C. or higher and 850° C. or lower, holding the steel sheet at the soaking temperature, and then cooling the steel sheet to a temperature range of 200° C. to 450° C. at an average cooling rate of 70° C./s or more. Optionally, the method may further comprise holding the steel sheet at the cooling stop temperature for 300 seconds or less.

Hot-Rolling Finish Temperature: 800° C. or Higher and 950° C. or Lower

When the hot-rolling finish temperature of the hot rolling is higher than 950° C., since the microstructure after the hot rolling is coarsened, it is difficult to obtain fine martensite in the subsequent annealing. Further, when the hot-rolling finish temperature is lower than 800° C., the rolling is performed in a dual phase region of ferrite and austenite and coarse particles are formed on a surface layer of a steel sheet. Thus, it becomes difficult to obtain fine martensite in the subsequent annealing. Therefore, the hot-rolling finish temperature is set to 800° C. or higher and 950° C. or lower, and preferably 850° C. or higher and 920° C. or lower.

Rolling Reduction at a Final Stand Being 8% or More

The rolling reduction at a final stand in the hot rolling step is set to 8% or more. When the rolling reduction at a final stand is less than 8%, the grain size of martensite after the annealing becomes more than 5 μm, and thus desired bendability cannot be obtained. Further, a desired volume fraction of martensite cannot be obtained after the annealing, and ductility is lowered. Therefore, the rolling reduction at a final stand is set to be 8% or more, and preferably 10% or more. The upper limit placed on the rolling reduction at a final stand is preferably set to 15% or less from the viewpoint of rolling load.

Coiling Temperature: 700° C. or Lower

When the coiling temperature is higher than 700° C., crystal grains are coarsened during the coiling and fine martensite cannot be obtained during the annealing. Therefore, the coiling temperature is set to 700° C. or lower, and preferably 450° C. or higher and 650° C. or lower.

Rolling Reduction in Cold Rolling: 80% or More

By setting the rolling reduction in the cold rolling to 80% or more, crystal grains after the cold rolling become fine. Thus, crystal grains become fine during the annealing, making it possible to form fine martensite during the cooling after the annealing. To obtain this effect, the rolling reduction needs to be 80% or more. On the other hand, when the rolling reduction is more than 95%, the rolling load significantly increases and high load is applied to a mill. Therefore, the rolling reduction is preferably 95% or less.

Average Heating Rate being 2° C./s or More and 35° C./s or Less within a Temperature Range of 200° C. to a Soaking Temperature When the average heating rate is less than 2° C./s within a temperature range of 200° C. to a soaking temperature, the ratio of martensite having a grain size of 2 μm or less in the entire martensite is less than 80%, and wrinkles are generated at a bent portion such as a pull tab ring formed by severe bending. Further, a desired volume fraction of martensite cannot be obtained, lowering ductility. When the average heating rate up to a soaking temperature is more than 35° C./s, a large amount of non-recrystallized microstructures remain during the annealing at an annealing temperature of 700° C. or higher and 850° C. or lower, non-uniform strains are applied to a steel sheet during processing to deteriorate bendability, and wrinkles are generated at a bent portion such as a pull tab ring which is subjected to severe bending. Therefore, the average heating rate up to a soaking temperature is set to 2° C./s or more and 35° C./s or less. The average heating rate up to a soaking temperature is preferably set to 3° C./s or more and 25° C./s or less.

Annealing Temperature: 700° C. or Higher and 850° C. or Lower

When the annealing temperature is lower than 700° C., a desired amount of martensite cannot be obtained, lowering strength. On the other hand, when the annealing temperature is higher than 850° C., coarse crystal grains are formed during the annealing and the maximum martensite grain size becomes large, deteriorating bendability. Therefore, the annealing temperature is set to 700° C. or higher and 850° C. or lower, and preferably 750° C. or higher and 820° C. or lower.

Average Cooling Rate: 70° C./s or More

When the average cooling rate is less than 70° C./s, formation of martensite is suppressed during the cooling and a desired amount of martensite cannot be obtained, lowering strength. Therefore, the average cooling rate is set to 70° C./s or more, and preferably 80° C./s or more and 250° C./s or less. The cooling can be performed by employing one or two or more in combination selected from gas cooling, furnace cooling, mist cooling, roll cooling, water cooling, and the like.

Cooling Stop Temperature: 200° C. or Higher and 450° C. or Lower

By setting the cooling stop temperature after the annealing to 450° C. or lower, martensite transformation occurs and a desired amount of martensite can be obtained. On the other hand, even if the cooling stop temperature is set to lower than 200° C., the amount of martensite formed does not change, but excessive cooling cost is incurred. Therefore, the cooling stop temperature after the annealing is set to 200° C. or higher and 450° C. or lower.

Optionally, the method may further comprise holding the steel sheet in a temperature range of from a cooling stop temperature to 150° C. for 300 seconds or less.

Holding Time in a Temperature Range of From Cooling Stop Temperature to 150° C.: 300 Seconds or Less When the holding time in temperature range of from a cooling stop temperature to 150° C. is more than 300 seconds, tempering of martensite is generated during the holding, and a desired amount of martensite cannot be obtained, lowering strength. Further, in this disclosure, although the steel sheet can be subjected to mild cooling without the holding, elongation can be further improved by performing the holding. Therefore, the holding time in a temperature range of from a cooling stop temperature to 150° C. is set to 1 second or more and 300 seconds or less. A holding temperature lower than 150° C. is not preferable because the elongation improving effect cannot be obtained.

In this way, the high-strength steel sheet according to this disclosure is produced.

EXAMPLES

The action and effect of a high-strength steel sheet according to this disclosure and the method for producing the same are described below with reference to the following examples.

Steel samples having the chemical compositions listed in Table 1 were obtained by steelmaking to produce sheet bar slabs having a sheet thickness of 20 mm from the steel samples. These sheet bar slabs were subjected to hot rolling under the conditions listed in Table 2. The obtained hot-rolled sheets were subjected to pickling with hydrochloric acid and cold rolling with the rolling ratios listed in Table 2 to produce cold-rolled steel sheets having a sheet thickness of 0.2 mm. It is noted that in the steel sample ID of O listed in Table 1, Ti: 0.001%, B: 0.0001%, and Nb: 0.001% were inevitably included.

Next, the cold-rolled steel sheets were subjected to heating, annealing and holding, cooling, and holding after cooling stop under the heat treatment conditions listed in Table 2 to obtain product steel sheets. The holding after cooling stop was performed in a temperature range of from a cooling stop temperature to 150° C.

TABLE 1

| Steel sample | Chemical composition (mass %) | | | | | | | | | | | | |
|---|---|---|---|---|---|---|---|---|---|---|---|---|---|
| ID | C | Si | Mn | P | S | Al | N | Ti | B | Nb | Cr | Ni | Mo |
| A | 0.03 | 0.02 | 1.48 | 0.018 | 0.011 | 0.070 | 0.0027 | 0.008 | 0.0052 | 0.016 | — | — | — |
| B | 0.08 | 0.03 | 1.24 | 0.013 | 0.012 | 0.077 | 0.0027 | 0.007 | 0.0051 | 0.015 | — | — | — |
| C | 0.13 | 0.03 | 1.25 | 0.019 | 0.014 | 0.074 | 0.0026 | 0.007 | 0.0048 | 0.016 | — | — | — |
| D | 0.14 | 0.01 | 0.61 | 0.018 | 0.008 | 0.065 | 0.0043 | 0.013 | 0.0031 | 0.005 | — | — | — |
| E | 0.06 | 0.03 | 0.80 | 0.014 | 0.012 | 0.082 | 0.0035 | 0.015 | 0.0025 | 0.008 | — | — | — |
| F | 0.07 | 0.03 | 1.25 | 0.018 | 0.010 | 0.088 | 0.0034 | 0.014 | 0.0025 | 0.007 | — | — | — |
| G | 0.05 | 0.03 | 1.45 | 0.017 | 0.016 | 0.085 | 0.0035 | 0.014 | 0.0026 | 0.009 | — | — | — |
| H | 0.05 | 0.02 | 1.26 | 0.020 | 0.016 | 0.067 | 0.0053 | 0.013 | 0.0075 | 0.008 | 0.080 | — | — |
| I | 0.04 | 0.02 | 1.32 | 0.015 | 0.014 | 0.066 | 0.0054 | 0.013 | 0.0080 | 0.008 | — | 0.130 | — |
| J | 0.06 | 0.03 | 1.18 | 0.017 | 0.012 | 0.072 | 0.0054 | 0.012 | 0.0078 | 0.008 | — | — | 0.040 |
| K | 0.01 | 0.02 | 1.25 | 0.015 | 0.011 | 0.066 | 0.007 | 0.010 | 0.0018 | 0.002 | — | — | — |
| L | 0.20 | 0.03 | 1.17 | 0.018 | 0.010 | 0.064 | 0.0068 | 0.011 | 0.0017 | 0.025 | — | — | — |
| M | 0.08 | 0.10 | 1.23 | 0.01 | 0.014 | 0.055 | 0.0069 | 0.010 | 0.0220 | 0.008 | — | — | — |
| N | 0.09 | 0.03 | 0.40 | 0.015 | 0.011 | 0.079 | 0.0015 | 0.008 | 0.0041 | 0.008 | — | — | — |
| O | 0.10 | 0.02 | 0.60 | 0.021 | 0.017 | 0.038 | 0.0022 | 0.007 | 0.0030 | 0.012 | — | — | — |

TABLE 1-continued

| Steel sample ID | Chemical composition (mass %) C | Si | Mn | P | S | Al | N | Ti | B | Nb | Cr | Ni | Mo |
|---|---|---|---|---|---|---|---|---|---|---|---|---|---|
| P | 0.05 | 0.03 | 2.12 | 0.018 | 0.011 | 0.081 | 0.0018 | 0.007 | 0.0042 | 0.008 | — | — | — |
| Q | 0.06 | 0.02 | 1.21 | 0.028 | 0.018 | 0.055 | 0.0011 | 0.012 | 0.0021 | 0.009 | — | — | — |
| R | 0.07 | 0.03 | 1.33 | 0.013 | 0.024 | 0.034 | 0.0028 | 0.009 | 0.0118 | 0.005 | — | — | — |
| S | 0.11 | 0.02 | 0.92 | 0.017 | 0.015 | 0.121 | 0.0043 | 0.011 | 0.0034 | 0.011 | — | — | — |
| T | 0.13 | 0.02 | 0.85 | 0.014 | 0.012 | 0.042 | 0.0118 | 0.015 | 0.0039 | 0.016 | — | — | — |
| U | 0.04 | 0.03 | 1.48 | 0.012 | 0.017 | 0.097 | 0.0047 | 0.022 | 0.0027 | 0.012 | — | — | — |
| V | 0.06 | 0.02 | 1.32 | 0.013 | 0.015 | 0.035 | 0.0019 | 0.001 | 0.0001 | 0.001 | — | — | — |

TABLE 2

| No. | Steel sample ID | Hot rolling conditions: Slab heating temperature (° C.) | Finisher delivery temperature (° C.) | Final stand rolling reduction (%) | Coilling temperature (° C.) | Cold rolling conditions Rolling reduction (%) | Heat treatment conditions: Heating rate (° C./s) | Soaking temperature (° C.) | Cooling rate (° C./s) | Cooling stop temperature (° C.) | Holding time (second) | Remarks |
|---|---|---|---|---|---|---|---|---|---|---|---|---|
| 1 | A | 1250 | 880 | 10 | 650 | 90 | 15 | 780 | 80 | 350 | 30 | Example |
| 2 | A | 1250 | 880 | 10 | 650 | 90 | 15 | 780 | 80 | 350 | 0 | Example |
| 3 | A | 1250 | 880 | 10 | 650 | 90 | 10 | 780 | 80 | 350 | 300 | Example |
| 4 | B | 1250 | 900 | 8 | 600 | 90 | 3 | 780 | 100 | 420 | 30 | Example |
| 5 | B | 1250 | 850 | 8 | 600 | 90 | 20 | 780 | 70 | 420 | 30 | Example |
| 6 | C | 1250 | 900 | 9 | 600 | 90 | 20 | 780 | 80 | 350 | 30 | Example |
| 7 | D | 1180 | 840 | 11 | 580 | 80 | 5 | 750 | 90 | 250 | 0 | Example |
| 8 | E | 1250 | 890 | 9 | 600 | 88 | 5 | 800 | 80 | 350 | 30 | Example |
| 9 | E | 1250 | 890 | 9 | 600 | 88 | 5 | 800 | 80 | 350 | 0 | Example |
| 10 | F | 1230 | 890 | 10 | 580 | 92 | 20 | 820 | 80 | 250 | 30 | Example |
| 11 | G | 1230 | 890 | 11 | 620 | 92 | 20 | 820 | 80 | 350 | 60 | Example |
| 12 | G | 1230 | 890 | 12 | 620 | 92 | 20 | 820 | 80 | 350 | 60 | Example |
| 13 | H | 1250 | 860 | 13 | 550 | 88 | 35 | 750 | 80 | 350 | 30 | Example |
| 14 | I | 1250 | 870 | 10 | 550 | 89 | 25 | 750 | 80 | 350 | 30 | Example |
| 15 | J | 1200 | 850 | 12 | 550 | 85 | 20 | 770 | 80 | 350 | 30 | Example |
| 16 | K | 1200 | 880 | 10 | 550 | 88 | 20 | 790 | 80 | 350 | 30 | Comparative Example |
| 17 | L | 1200 | 890 | 10 | 450 | 88 | 30 | 760 | 80 | 350 | 30 | Comparative Example |
| 18 | M | 1200 | 890 | 11 | 550 | 88 | 10 | 750 | 80 | 350 | 150 | Comparative Example |
| 19 | N | 1200 | 900 | 10 | 550 | 88 | 5 | 750 | 80 | 350 | 300 | Comparative Example |
| 20 | O | 1220 | 830 | 11 | 580 | 90 | 10 | 720 | 100 | 450 | 60 | Comparative Example |
| 21 | P | 1200 | 880 | 11 | 550 | 88 | 30 | 750 | 80 | 350 | 30 | Comparative Example |
| 22 | Q | 1180 | 850 | 9 | 650 | 85 | 15 | 775 | 100 | 400 | 30 | Comparative Example |
| 23 | R | 1220 | 900 | 9 | 620 | 85 | 15 | 800 | 100 | 350 | 60 | Comparative Example |
| 24 | S | 1200 | 870 | 9 | 580 | 90 | 25 | 820 | 120 | 450 | 60 | Comparative Example |
| 25 | T | 1250 | 850 | 8 | 580 | 87 | 25 | 820 | 120 | 450 | 150 | Comparative Example |
| 26 | U | 1230 | 890 | 8 | 520 | 82 | 20 | 790 | 80 | 250 | 150 | Comparative Example |
| 27 | V | 1230 | 890 | 10 | 650 | 90 | 10 | 800 | 80 | 400 | 30 | Comparative Example |
| 28 | A | 1240 | 700 | 10 | 620 | 90 | 10 | 750 | 80 | 350 | 30 | Comparative Example |
| 29 | A | 1240 | 960 | 10 | 620 | 90 | 10 | 750 | 80 | 350 | 30 | Comparative Example |
| 30 | B | 1230 | 900 | 10 | 750 | 90 | 30 | 750 | 80 | 350 | 30 | Comparative Example |
| 31 | B | 1230 | 900 | 9 | 650 | 50 | 30 | 750 | 80 | 350 | 30 | Comparative Example |
| 32 | B | 1230 | 900 | 9 | 650 | 90 | 20 | 650 | 80 | 350 | 30 | Comparative Example |
| 33 | B | 1230 | 900 | 11 | 650 | 90 | 25 | 950 | 80 | 350 | 30 | Comparative Example |
| 34 | F | 1250 | 880 | 8 | 620 | 91 | 25 | 750 | 10 | 350 | 30 | Comparative Example |
| 35 | F | 1250 | 880 | 8 | 620 | 91 | 15 | 750 | 80 | 600 | 30 | Comparative Example |
| 36 | F | 1250 | 880 | 9 | 620 | 91 | 15 | 750 | 80 | 350 | 600 | Comparative Example |
| 37 | D | 1230 | 900 | 6 | 650 | 90 | 10 | 790 | 80 | 350 | 30 | Comparative Example |
| 38 | E | 1250 | 880 | 9 | 620 | 90 | 1 | 780 | 90 | 350 | 30 | Comparative Example |

The microstructure and mechanical properties of the product steel sheets obtained as stated above were examined as below. The obtained results are listed in Table 3.

The area ratio of each microstructure in the entire microstructure was analyzed by etching with natal a surface in a cross section along a rolling direction at a ½ position of a sheet thickness and then observing the surface with a scanning electron microscope (SEM). The observation was performed in five randomly selected fields. The area occupied by each microstructure present in an arbitrarily set square area having a size of 50 μm×50 μm was determined by binarization of a sectional micrograph at 2000 times magnification using an image analysis software (Photoshop, available from Adobe Systems Co., Ltd.) and an average of the occupancy areas of each microstructure in the five fields was calculated as the area ratio of each microstructure.

A white region having a relatively smooth surface and observed as having a massive shape was regarded as martensite and the area ratio of this region was defined as the martensite area ratio. For the martensite grain size, equivalent circular diameters were calculated from the occupancy area of martensite and a maximum equivalent circular diameter was determined for each observation field. One of the equivalent circular diameters that was largest in the five randomly selected observation fields was defined as the martensite grain size. The ratio of martensite having a diameter of 2 μm or less in the entire martensite was determined by determining the ratio of the number of martensite having an equivalent circular diameter of 2 μm or less to the total number of martensite in each observation field and averaging the ratios for the five randomly selected observation fields.

A black region observed as having a massive shape and including no martensite was regarded as ferrite and the area ratio of this region was defined as the ferrite area ratio.

Mechanical Properties

Mechanical properties (tensile strength TS and elongation EL) were evaluated by performing a tensile test according to JIS Z2241 using No. 5 test pieces prepared according to JIS Z2241 such that the longitudinal direction (tensile direction) was parallel to the rolling direction.

Bend Test

The bendability was evaluated by performing a 180° bend test according to JIS Z 2248 using No. 3 test pieces prepared according to JIS Z2248. The distance between the end parts of each sheet during bending was twice the sheet thickness. For evaluation, after each test piece was taken from a bend device, the outside of a curved portion was observed using a loupe of ten magnifications. When the curved portion had no cracks, the test piece was judged as having excellent bendability (bendability: "good"), and when the curved portion had a crack, the test piece was judged as having poor bendability (bendability: "poor").

Pull Tab Ring Workability

A pull tab was made by collecting a strip blank from each steel sheet and subjecting the blank to bending followed by curling. The pull tab thus made was observed using a stereoscopic microscope in four locations in the circumferential direction of the bent tip of the ring portion thereof to verify the presence or absence of wrinkles. A pull tab having no wrinkles in all the four locations in the circumferential direction was judged as "passed" and a pull tab having a wrinkle in any location in the circumferential direction was judged as "failed".

It was found that the steel sheets of our examples had TS of 500 MPa or more, El of 15% or more, and excellent bendability, and bent portions such as pull tab rings made from the steel sheets by severe bending had no wrinkles. On the other hand, as it can be seen from the EXAMPLE section, the steel sheets of the comparative examples out of the scope of this disclosure were unsatisfactory in terms of at least one of TS, EL, and bendability, and their ductility or bendability were significantly inferior to the steel sheets according to this disclosure. Further, some of these steel sheets had wrinkles at the bent portions made by severe bending.

TABLE 3

| No. | Steel sample ID | Ferrite area ratio (%) | Martensite area ratio (%) | Martensite maximum grain size (μm) | Martensite of 2 μm or less (%) | TS (MPa) | EL (%) | 180° bending | Ring portion bending | Evaluation | Remarks |
|---|---|---|---|---|---|---|---|---|---|---|---|
| 1 | A | 96.0 | 4.0 | 2.8 | 88 | 512 | 32.8 | good | passed | good | Example |
| 2 | A | 95.0 | 5.0 | 2.5 | 92 | 556 | 28.7 | good | passed | good | Example |
| 3 | A | 96.0 | 4.0 | 2.6 | 90 | 529 | 31.2 | good | passed | good | Example |
| 4 | B | 93.0 | 7.0 | 3.3 | 90 | 598 | 26.4 | good | passed | good | Example |
| 5 | B | 94.0 | 6.0 | 3.1 | 88 | 576 | 27.2 | good | passed | good | Example |
| 6 | C | 91.0 | 9.0 | 3.2 | 85 | 628 | 25.2 | good | passed | good | Example |
| 7 | D | 95.0 | 5.0 | 2.6 | 92 | 574 | 28.1 | good | passed | good | Example |
| 8 | E | 97.0 | 3.0 | 2.4 | 95 | 523 | 29.6 | good | passed | good | Example |
| 9 | E | 94.0 | 6.0 | 2.5 | 94 | 547 | 26.8 | good | passed | good | Example |
| 10 | F | 95.0 | 5.0 | 3.6 | 91 | 601 | 26.5 | good | passed | good | Example |
| 11 | G | 92.0 | 8.0 | 4.2 | 84 | 622 | 24.1 | good | passed | good | Example |
| 12 | G | 92.0 | 7.9 | 3.8 | 86 | 615 | 27.2 | good | passed | good | Example |
| 13 | H | 93.0 | 7.0 | 3.2 | 93 | 582 | 25.8 | good | passed | good | Example |
| 14 | I | 92.0 | 8.0 | 2.8 | 91 | 567 | 27.4 | good | passed | good | Example |
| 15 | J | 91.0 | 9.0 | 2.9 | 92 | 572 | 26.3 | good | passed | good | Example |
| 16 | K | 99.3 | 0.7 | 1.2 | 100 | 412 | 35.2 | good | passed | poor | Comparative Example |
| 17 | L | 80.0 | 20.0 | 4.2 | 78 | 728 | 6.3 | poor | failed | poor | Comparative Example |
| 18 | M | 83.0 | 17.0 | 6.2 | 75 | 661 | 15.6 | poor | failed | poor | Comparative Example |
| 19 | N | 99.2 | 0.8 | 0.8 | 100 | 408 | 35.6 | good | passed | poor | Comparative Example |
| 20 | O | 99.2 | 0.8 | 1.2 | 98 | 487 | 28.3 | good | passed | poor | Comparative Example |
| 21 | P | 82.0 | 18.0 | 5.2 | 70 | 682 | 12 | poor | failed | poor | Comparative Example |
| 22 | Q | 86.0 | 14.0 | 4.7 | 68 | 665 | 14.7 | poor | failed | poor | Comparative Example |
| 23 | R | 93.0 | 7.0 | 3.6 | 75 | 586 | 13.4 | poor | failed | poor | Comparative Example |
| 24 | S | 97.0 | 3.0 | 2.8 | 78 | 598 | 19.8 | poor | failed | poor | Comparative Example |
| 25 | T | 87.0 | 13.0 | 5.2 | 65 | 647 | 13.8 | poor | failed | poor | Comparative Example |
| 26 | U | 88.0 | 12.0 | 3.5 | 76 | 663 | 14.2 | poor | failed | poor | Comparative Example |
| 27 | V | 99.5 | 0.5 | 0.8 | 100 | 432 | 32.8 | good | passed | poor | Comparative Example |
| 28 | A | 93.0 | 7.0 | 4.2 | 70 | 582 | 28.4 | poor | failed | poor | Comparative Example |
| 29 | A | 92.0 | 8.0 | 4.8 | 65 | 577 | 29.7 | poor | failed | poor | Comparative Example |
| 30 | B | 95.0 | 5.0 | 5.8 | 60 | 585 | 21.1 | poor | failed | poor | Comparative Example |
| 31 | B | 99.2 | 0.8 | 5.2 | 99 | 472 | 36.5 | poor | passed | poor | Comparative Example |
| 32 | B | 99.9 | 0.1 | — | — | 483 | 15.2 | good | passed | poor | Comparative Example |
| 33 | B | 93.0 | 7.0 | 6.2 | 35 | 598 | 26 | poor | failed | poor | Comparative Example |
| 34 | F | 99.4 | 0.6 | 2.3 | 92 | 467 | 29.3 | good | passed | poor | Comparative Example |
| 35 | F | 99.5 | 0.5 | 1.8 | 96 | 472 | 31.2 | good | passed | poor | Comparative Example |
| 36 | F | 99.2 | 0.8 | 1.5 | 100 | 466 | 30.8 | good | passed | poor | Comparative Example |
| 37 | D | 88.0 | 12.0 | 5.5 | 82 | 621 | 14.2 | poor | passed | poor | Comparative Example |
| 38 | E | 89.0 | 11.0 | 4.5 | 75 | 585 | 14.5 | poor | failed | poor | Comparative Example |

The invention claimed is:

1. A high-strength steel sheet comprising a chemical composition containing, in mass %, C: 0.03% or more and 0.15% or less, Si: 0.01% or more and 0.05% or less, Mn: more than 0.6% and 1.5% or less, P: 0.025% or less, S: 0.02% or less, Al: 0.01% or more and 0.088% or less, N: 0.0005% or more and 0.0100% or less, Ti: 0.005% or more and 0.020% or less, B: 0.0005% or more and 0.0100% or less, Nb: 0.005% or more and 0.020% or less, and optionally at least one selected from the group consisting of Cr: 0.005% or more and 0.100% or less, Ni: 0.005% or more and 0.150% or less, and Mo: 0.005% or more and 0.050% or less, with the balance being Fe and inevitable impurities, wherein the high-strength steel sheet has a metallic structure consisting of, in area ratio, 90% or more and 99% or less of ferrite and 1% or more and 10% or less of martensite, the martensite has a maximum grain size of 5 μm or less, and a ratio of martensite having a grain size of 2 μm or less is 80% or more, the high-strength steel sheet has a tensile strength of 512 MPa or more, and the high-strength steel sheet has a sheet thickness of 0.1 to 0.8 mm.

2. The high-strength steel sheet according to claim 1, wherein the area ratio of the martensite in the metallic structure is less than 8%.

3. A method for producing a high-strength steel sheet of claim 1, the method comprising:

hot rolling a slab having the chemical composition according to claim 1 with a hot-rolling finish temperature of 800° C. or higher and 950° C. or lower, a rolling reduction at a final stand of 8% or more, and a coiling temperature of 700° C. or lower to obtain a hot-rolled sheet;

cold rolling the hot-rolled sheet with a rolling reduction of 80% or more to obtain a cold-rolled sheet; and subjecting the cold-rolled sheet to annealing whereby the cold-rolled sheet is heated at an average heating rate of 2° C/s or more and 35° C/s or less within a temperature range of 200° C. to a soaking temperature of 700° C. or higher and 850° C. or lower, held at the soaking temperature, and then cooled to a temperature range of 200° C. to 450° C. at an average cooling rate of 70° C/s or more to obtain an annealed sheet.

4. The method for producing a high-strength steel sheet according to claim 3, the method further comprising: holding the annealed sheet for 300 seconds or less at a temperature not lower than 150° C. and not higher than a cooling stop temperature of the cooling.

5. The high-strength steel sheet according to claim 1, wherein the high-strength steel sheet has an elongation of 15% or more.

* * * * *